US010107472B2

(12) United States Patent
Vice, Jr. et al.

(10) Patent No.: US 10,107,472 B2
(45) Date of Patent: Oct. 23, 2018

(54) LUMINAIRE WITH SLOT-MOUNTED LED MODULE

(71) Applicant: Focal Point, LLC, Chicago, IL (US)

(72) Inventors: Edwin Vice, Jr., Chicago, IL (US); Ken Czech, Naperville, IL (US); Mohamed Aslam Khazi, Bloomfield, RI (US); Josue Moctezuma, Lake Beach, IL (US); Scott Pahl, Lisle, IL (US); Zach Payne, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 196 days.

(21) Appl. No.: 15/143,056

(22) Filed: Apr. 29, 2016

(65) Prior Publication Data

US 2017/0314760 A1 Nov. 2, 2017

(51) Int. Cl.

| | |
|---|---|
| ***F21V 19/00*** | (2006.01) |
| ***F21V 3/00*** | (2015.01) |
| ***F21V 5/04*** | (2006.01) |
| ***F21V 29/75*** | (2015.01) |
| ***F21V 17/00*** | (2006.01) |
| ***F21V 17/12*** | (2006.01) |
| ***F21V 23/00*** | (2015.01) |
| *F21S 8/02* | (2006.01) |
| *F21V 7/06* | (2006.01) |
| *F21Y 105/10* | (2016.01) |
| *F21Y 115/10* | (2016.01) |
| *F21K 9/66* | (2016.01) |
| *F21K 9/68* | (2016.01) |

(52) U.S. Cl.

CPC ..... *F21V 3/00* (2013.01); *F21V 5/04* (2013.01); *F21V 17/002* (2013.01); *F21V 17/12* (2013.01); *F21V 23/001* (2013.01); *F21V 29/75* (2015.01); *F21K 9/66* (2016.08); *F21K 9/68* (2016.08); *F21S 8/026* (2013.01); *F21V 7/06* (2013.01); *F21Y 2105/10* (2016.08); *F21Y 2115/10* (2016.08)

(58) Field of Classification Search

CPC .. F21V 19/0045; F21V 19/003; F21V 19/002; F21V 17/104; F21V 29/70; F21V 29/74; F21V 29/767; F21V 29/773; F21V 29/777; F21Y 2105/10; F21Y 2105/16

See application file for complete search history.

(56) References Cited

U.S. PATENT DOCUMENTS

| | | | | |
|---|---|---|---|---|
| 2,926,237 A * | 2/1960 | Sorenson | F21V 17/107 | 362/150 |
| 7,223,003 B2 * | 5/2007 | Kim | F21V 29/004 | 362/561 |
| 7,344,296 B2 * | 3/2008 | Matsui | F21K 9/00 | 362/249.01 |
| 7,588,345 B1 * | 9/2009 | Davis | F21S 8/02 | 362/223 |
| 7,641,373 B2 * | 1/2010 | Sugawara | G02F 1/133604 | 362/217.01 |

(Continued)

*Primary Examiner* — Ismael Negron

(74) *Attorney, Agent, or Firm* — Banner & Witcoff, Ltd.

(57) ABSTRACT

A luminaire has a LED module, a block structure with a cavity, a plurality of fins extending from the block structure, and a slot extending through a sidewall of the block into the cavity. The LED module is slidably received on a mounting surface of the slot and configured to project light through an aperture of the cavity. The mounting surface has an area equal to or larger than that of the aperture.

15 Claims, 20 Drawing Sheets

(56) References Cited

U.S. PATENT DOCUMENTS

| | | | | |
|---|---|---|---|---|
| 7,963,672 | B2 * | 6/2011 | Liu | F21V 17/101<br>362/249.02 |
| 7,967,480 | B2 * | 6/2011 | Pickard | F21V 21/048<br>362/362 |
| 8,292,482 | B2 * | 10/2012 | Harbers | F21K 9/00<br>362/373 |
| 9,447,949 | B2 * | 9/2016 | Rashidi Doust | F21V 17/02 |
| 2004/0233672 | A1 * | 11/2004 | Dubuc | A01G 7/045<br>362/294 |
| 2007/0047229 | A1 * | 3/2007 | Lee | F21V 5/04<br>362/237 |
| 2011/0001060 | A1 * | 1/2011 | Welker | A61L 9/20<br>250/455.11 |
| 2011/0176308 | A1 * | 7/2011 | Wu | F21V 7/005<br>362/247 |

* cited by examiner

LUMINAIRE WITH SLOT-MOUNTED LED MODULE

BACKGROUND

A luminaire may comprise elements configured to accommodate a specific circuit board or LED module design. For example, a light engine assembly or an optical assembly may be designed to accommodate a specific size of circuit board or LED module containing a specific configuration of one or more light sources. Accordingly, each of a plurality of different luminaire circuit boards or modules may be associated with a single light engine design.

BRIEF SUMMARY

According to one aspect, a luminaire may include a light engine assembly, a reflector assembly slidably engaged with the light engine assembly, and an LED module. The light engine may include: a plurality of fins, integrally-formed with, and extending from, a block structure; a cavity extending in a first direction from the block structure creating an aperture; a slot, extending through a sidewall of the block structure into the cavity in a second direction, perpendicular to the first direction, the slot comprising a mounting surface having a surface area equal to or larger than an area of the aperture. The LED module may be removably-coupled to the mounting surface. The LED module may comprise at least one light source configured to emit light through the aperture. Further, the LED module may be removable from the cavity and slidable through the slot.

According to another aspect, a luminaire may comprise a light engine assembly. The light engine assembly may include a block structure including a heat sink; a plurality of fins integrally-formed with, and extending from the block structure; a cavity extending in a first direction from an aperture in a bottom surface of the block structure; a slot extending through a sidewall of the block structure into the cavity in a second direction, perpendicular to the first direction, the slot comprising a mounting surface having a surface area larger than an area of the aperture; and an LED module, removably-coupled to the mounting surface, comprising at least one light source configured to emit light through the aperture. Additionally, the luminaire may comprise a reflector assembly slidably engaged with the block structure and a cover plate removably-coupled between a lower surface of the block structure and an upper flange of the reflector assembly. The cover plate may be removably-coupled to the light engine with one or more fasteners that provide a standoff distance between a surface of the cover plate and a flange of the one or more fasteners and the standoff distance allows the reflector assembly to slidably engage with the block structure. Additionally, the upper flange of the reflector assembly may slidably engage with the light engine assembly such that the flange of the reflector assembly is sandwiched between the flange of the one or more fasteners and the cover plate.

According to yet another aspect, a light engine assembly for a luminaire may comprise: a block structure; a plurality of fins integrally-formed with, and extending from the block structure; a cavity extending in a first direction from an aperture in a bottom surface of the block structure; and a slot extending through a sidewall of the block structure into the cavity in a second direction, perpendicular to the first direction, the slot comprising a mounting surface having a surface area larger than an area of the aperture. Additionally, the light engine assembly may include a cover structure removably-coupled to the light engine assembly to cover the slot. The mounting surface of the light engine may be configured to be removably-coupled to an LED module. The LED module may comprise at least one light source configured to emit light through the aperture. Further, the LED module may be removable from the cavity and slidable through the slot.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to a luminaire having a light engine assembly configured to be removably-coupled to a circuit board or LED module. Further, the light engine assembly, that includes a heat sink, may be configured to accommodate circuit boards or LED modules having different shapes and geometries.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

Figure 1:
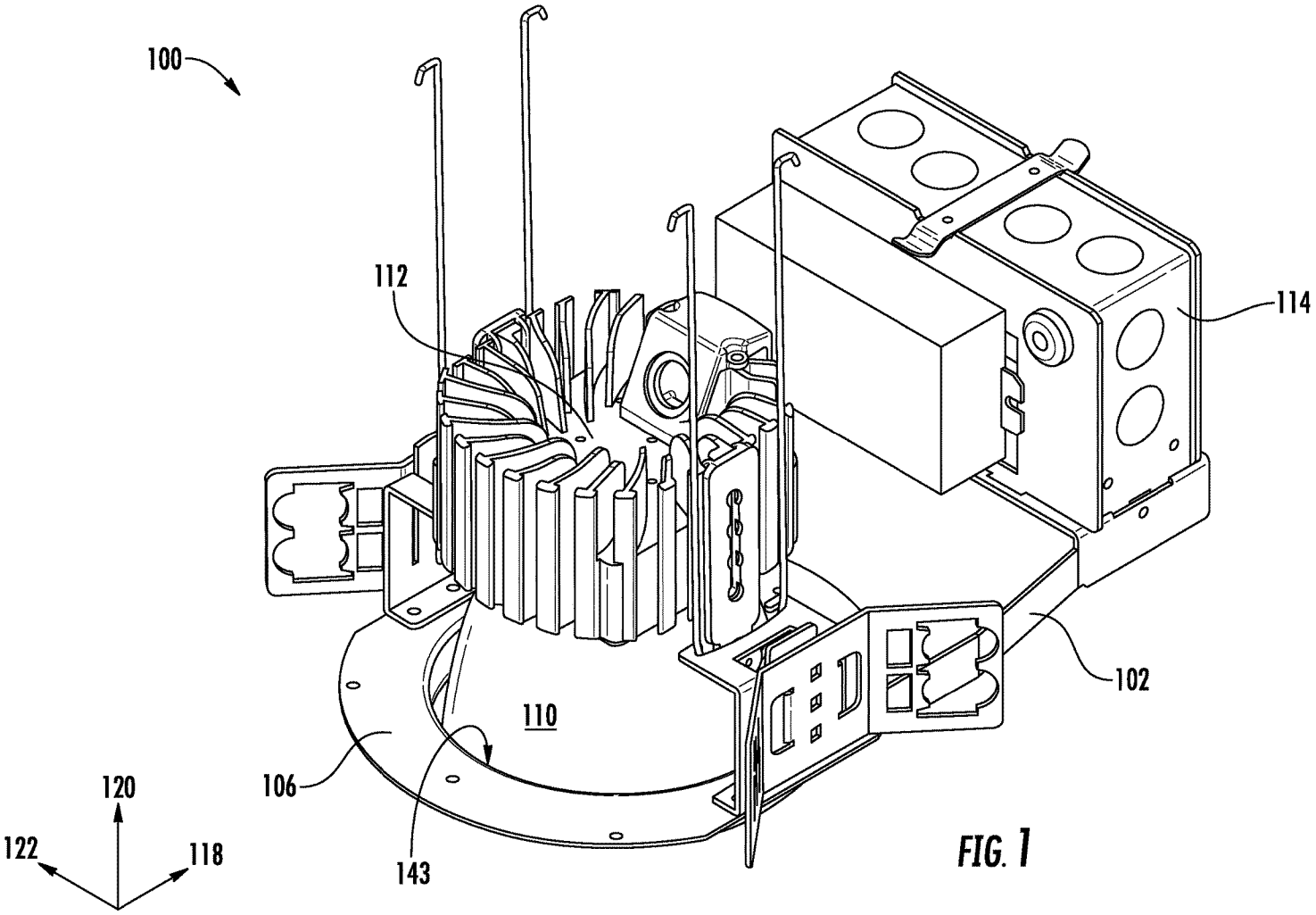
FIG. 1 depicts an isometric view of an example luminaire, according to one or more aspects described herein.
Figure 2A:
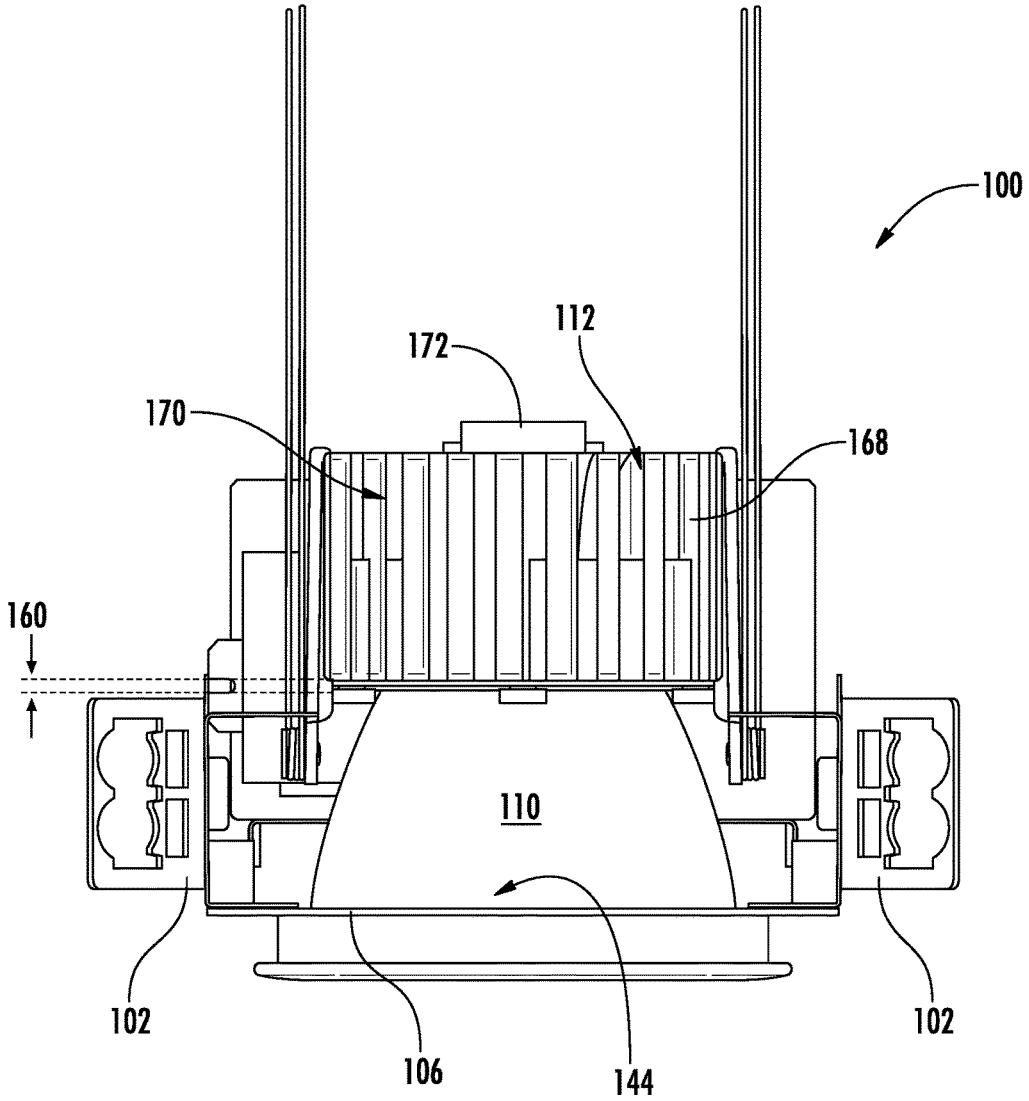
FIG. 2A depicts a front view of the example luminaire of FIG. 1, according to one or more aspects described herein.
Figure 2B:
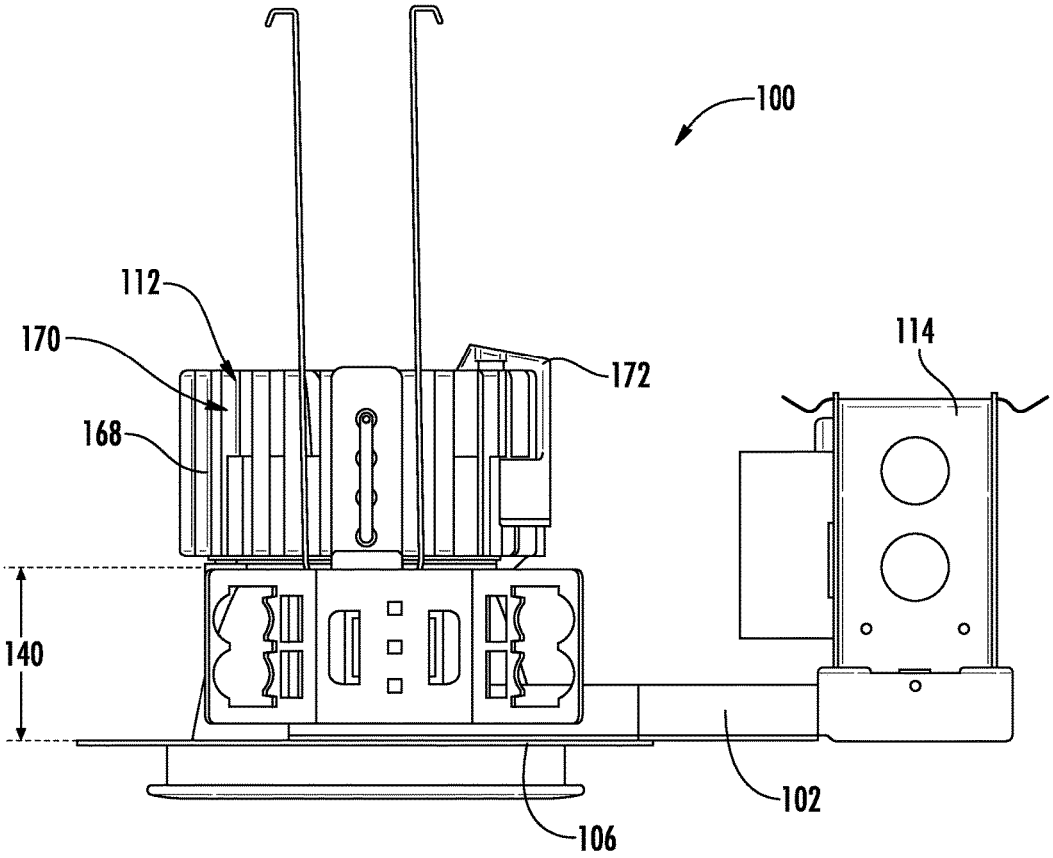
FIG. 2B depicts a side view of the example luminaire of FIG. 1, according to one or more aspects described herein.

FIG. 1 depicts an isometric view of an example luminaire 100, according to one or more aspects described herein. FIGS. 2A and 2B depict different views of the example luminaire 100, according to one or more aspects described herein. In particular, FIG. 2A depicts a front view and FIG. 2B depicts a side view of the luminaire 100. The luminaire 100 may comprise a mounting frame assembly 102 and an aperture plate 106 that is coupled to the mounting frame assembly 102. A reflector assembly 110 may be slidably engaged with, and removably-coupled to, a light engine assembly 112. The light engine assembly 112 may be coupled to the aperture plate 106 and/or the mounting frame assembly 102 in any variety of ways without departing from this invention. Additionally, the light engine assembly 112 may not utilize or be coupled with any aperture plate 106 or mounting frame assembly 102 and may be utilized as an individual and/or separate part and light engine. The light engine assembly 112 may include a heat sink 170 to provide a surface area from which heat energy generated by one or more light sources within the luminaire 100 may be dissipated.

Figure 4A:
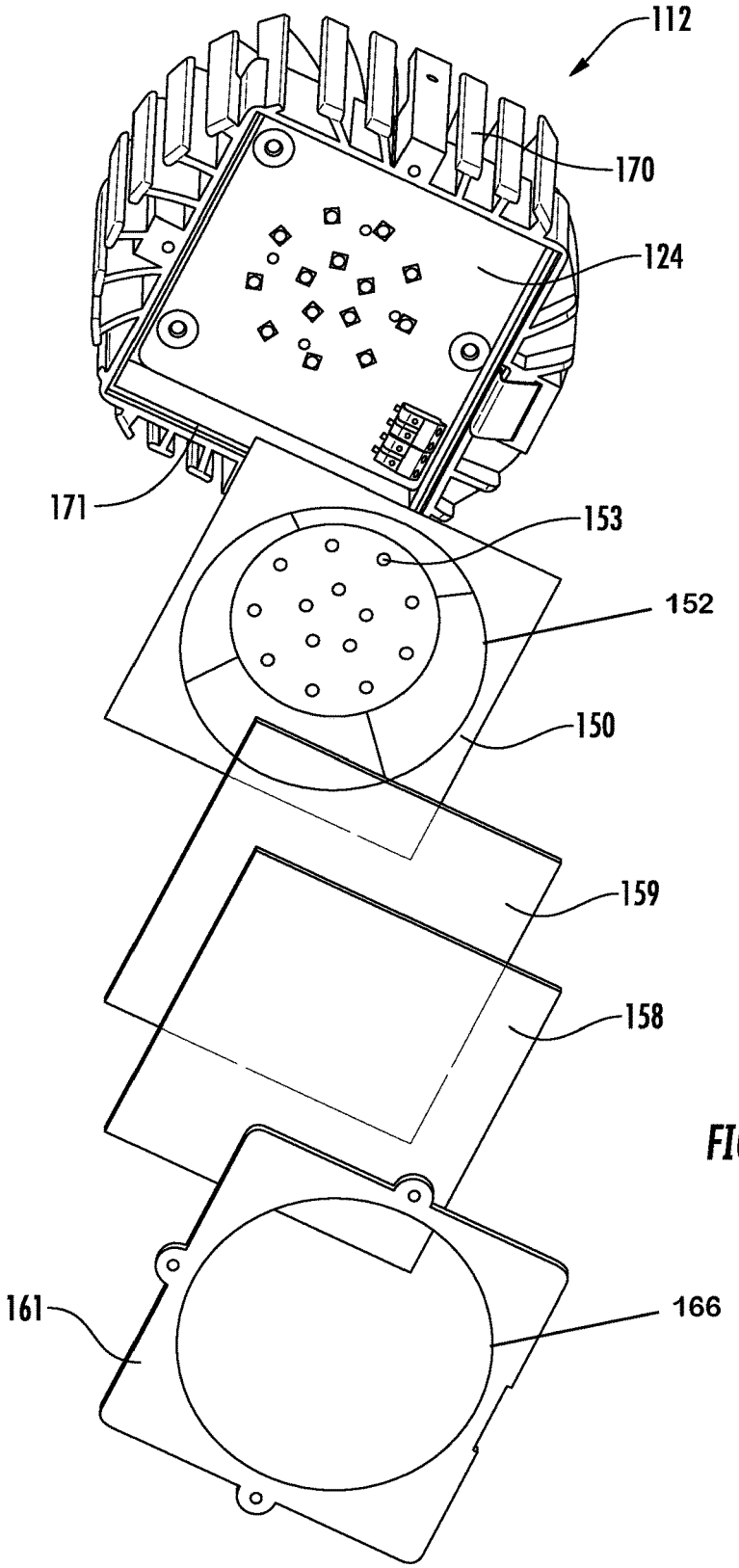
FIG. 4A depicts an exploded isometric view of a light engine assembly of the optical assembly of FIG. 3, according to one or more aspects described herein.
Figure 4B:
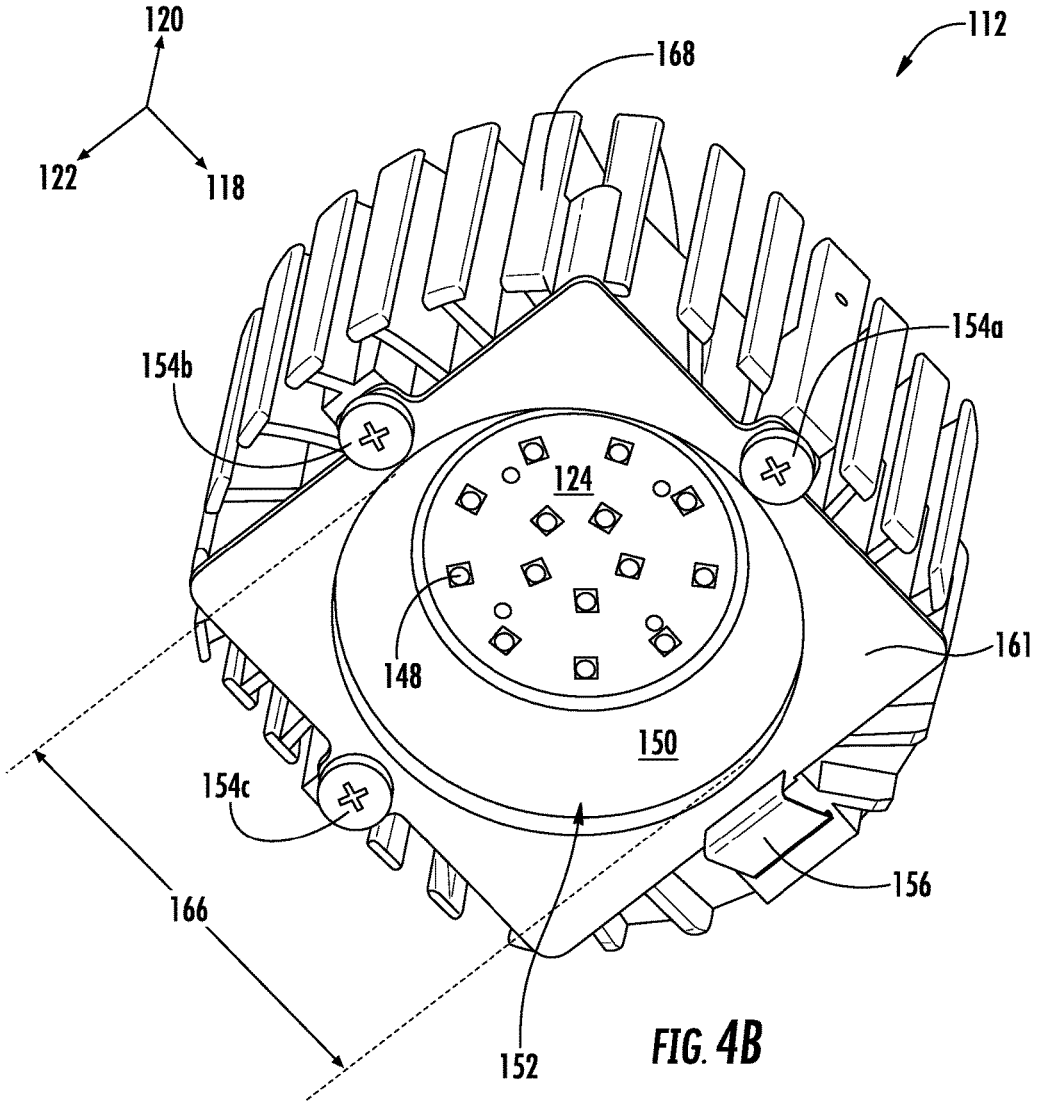
FIG. 4B depicts an isometric view of the bottom of the light engine assembly of the optical assembly of FIG. 3, according to one or more aspects described herein.
Figure 4C:
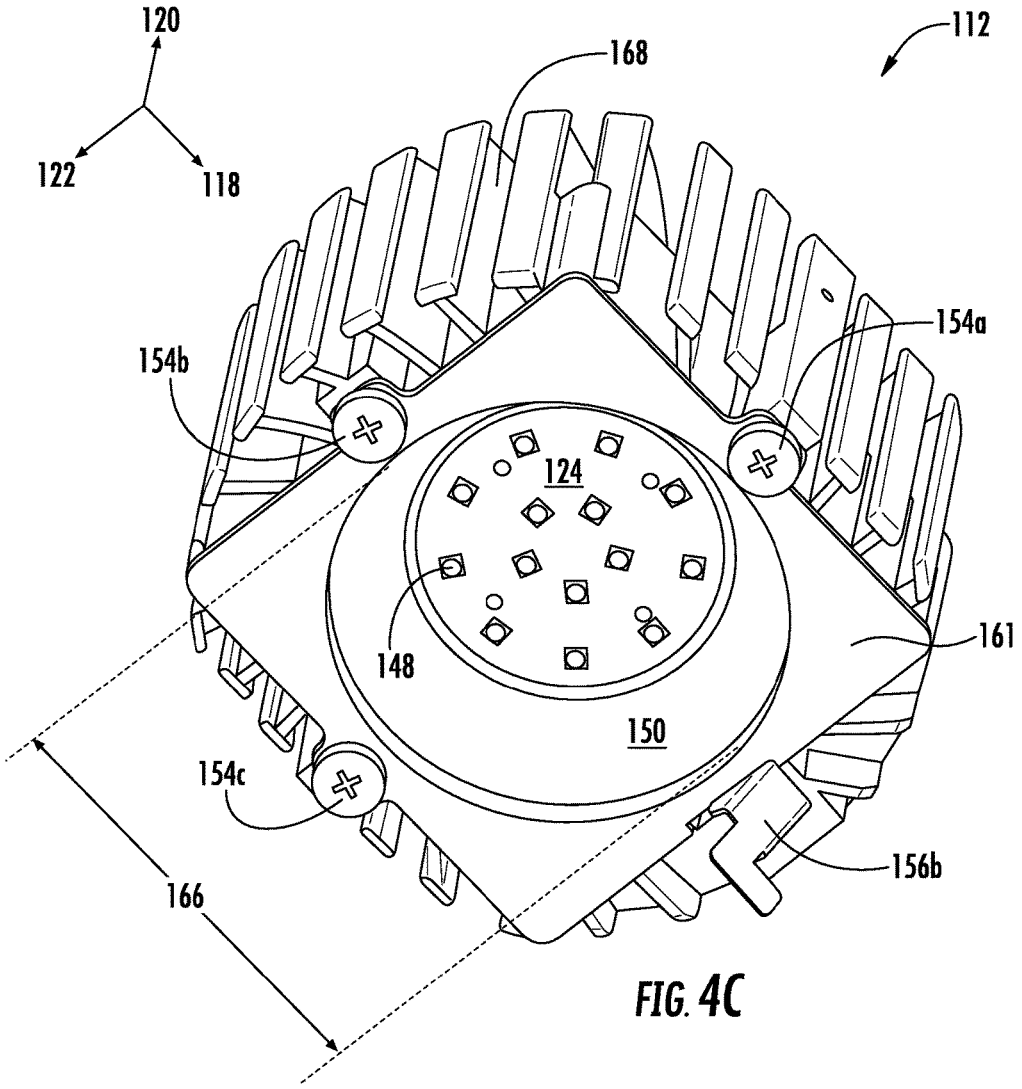
FIG. 4C depicts an isometric view of the bottom of another embodiment of the light engine assembly of the optical assembly of FIG. 3, according to one or more aspects described herein.

As illustrated in FIG. 4A, the light engine assembly 112 may include a circuit board or module 124 which may comprise one or more light sources. As such, light source 148 represents one such light source. In one example, light source 148 may be a light-emitting diode. In other implementations, light source 148 may comprise a different light source technology, including one or more incandescent, or fluorescent light source technologies. As depicted in FIGS. 4A through 4C, the circuit board or module 124 may comprise a plurality of light sources, similar to light source 148. Those of ordinary skill in the art will recognize that luminaire 100 may be implemented with any number of light sources 148, without departing from the scope of these disclosures. Similarly, a light source 148 may have any power rating, luminous efficacy, or color temperature, without departing from the scope of these disclosures. Additionally, those of ordinary skill in the art will recognize that circuit board or LED module 124 may comprise electronic components in addition to the one or more light sources 148, without departing from the scope of these disclosures. For example, the circuit board or LED module 124 may comprise one or more voltage regulation chips, resistors, capacitors, conduction pathways, sensors, or electrical connections, among others.

As further illustrated in FIGS. 3 and 4A-4C, the luminaire 100 may comprise a reflective chamber 150 positioned between reflector assembly 110 and the circuit board or LED module 124. As such, the reflective chamber 150 may comprise one or more apertures 152. In one example, the aperture 142 (as illustrated in FIG. 12C) of the reflector assembly 110, an aperture 143 (as illustrated in FIG. 1) of the aperture plate 106, and the aperture 152 of the reflective chamber 150 may be concentric with one another, and aligned along direction 120. Additionally, the reflective chamber 150 may include reflective surfaces.

FIG. 4A illustrates an exploded bottom view of the light engine assembly 112 in accordance with aspects of this invention. As illustrated in FIG. 4A, the light engine assembly 112 may include a circuit board or LED module 124 located within a heat sink 170. A reflective chamber 150 may be located over the circuit board or LED module 124. As illustrated in FIG. 4A, the reflective chamber 150 may include one or more apertures 153 that may align with the location of the LEDs or light sources 148 on the circuit board or LED module 124. Additionally, the edges of the reflective chamber 150 may be positioned within a ledge 171 of the heat sink 170. A lens or diffuser plate 159 may be located above the reflective chamber 150. As illustrated in FIG. 4A, the edges of the lens or diffuser plate 159 may be positioned within the ledge 171 on the heat sink 170. The lens or diffuser plate 159 may be configured to, among others: focus, scatter, diffuse, or alter a color temperature or hue of light emitted from one or more light sources 148. Additionally, there may be a notch in one of the corners or sides of the ledge 171 to correctly position and align with a notch on the reflective chamber 150 and the lens or diffuser plate 159. In an example embodiment, as illustrated in FIG. 4A, a lens cover 158 may also be included in addition to the lens or diffuser plate 159 to provide additional focusing, scattering, diffusing, or altering a color temperature or hue of light emitted from one or more light sources 148. A cover plate 161 may be located over the lens cover 158, lens or diffuser plate 159, and the reflective chamber 150. The cover plate 161 may be utilized to secure the lens cover 158, the lens or diffuser plate 159, and reflective chamber 150 to the heat sink 170 and the light engine assembly 112. The cover plate 161 may fit over the holes for securing one or more of the fasteners 154*a*-154*c* to the heat sink 170. As illustrated in FIG. 4A, the cover plate 161 may have an outer edge which aligns with the edges of the heat sink 170. The cover plate 161 may also include an aperture 166 that aligns with the lens cover 158, the lens or diffuser plate 159, and the reflective chamber 150.

Figure 4D:
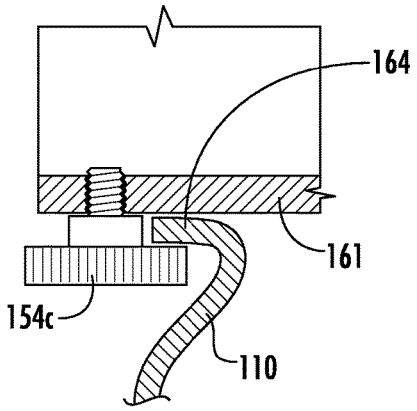
FIG. 4D depicts a close-up side section view of the light engine assembly of FIG. 3, according to one or more aspects described herein.

FIG. 4B depicts an isometric view of a bottom of the light engine assembly 112. Fasteners 154*a*-154*c* may be configured to couple the cover plate 161 (and/or lens or diffuser plate 159) to the light engine assembly 112. In one example, fasteners 154*a*-154*c* may comprise thumbscrews. In other examples, fasteners 154*a*-154*c* may comprise screws, bolts, rivets, or any other fastening structure. In one implementation, as illustrated in FIG. 4D, there may be a standoff distance between the surface of the cover plate 161, and the flanges of the fasteners 154*a*-154*c* (see, e.g., standoff distance 160 from FIG. 2A). The standoff distance 160 may allow the reflector assembly 110 to slidably engage with the light engine assembly 112. In one example, an upper flange 164 of the reflector assembly 110 may slidably engage with the light engine assembly 112, and slide along direction 118 such that the upper flange 164 of the reflector assembly 110 is sandwiched between the fasteners 154*a*-154*c* and the cover plate 161. The light engine assembly 112 may comprise a leaf spring 156 that is configured to compress along direction 120 as the upper flange 164 of the reflector assembly 110 slidably engages with the light engine assembly 112 along direction 118, and to expand to that position depicted in FIGS. 4A and 4B once the reflector assembly 110 is fully engaged with the light engine assembly 112.

FIG. 4C depicts an isometric view of a bottom of the light engine assembly 112. The light engine assembly 112 as illustrated in FIG. 4C comprises a manual slide closure 156*b* that is configured to slide between a first position and a second position. In the first position, the manual slide closure 156*b* is flush with the bottom of the light engine assembly 112, such that the upper flange 164 of the reflector assembly 110 slidably engages with the light engine assembly 112 along direction 118. Once the reflector assembly 110 is fully engaged with the light engine assembly 112, the manual slide closure 156*b* may be rotated to a second position, such that the reflector assembly 110 is locked into position on the light engine assembly 112 and held in place by the manual slide closure 156*b*.

The cover plate 161 may comprise an aperture 166. Accordingly, aperture 166 may be embodied with any shape and/or dimensions, without departing from the scope of these disclosures. The aperture 166 of the cover plate 161 may have a round or square shape. In one implementation, the cover plate 161 is used to retain the lens cover 158, the lens or diffuser plate 159, and/or the reflective chamber 150 within the ledge 171 of the heat sink 170.

Figure 3:
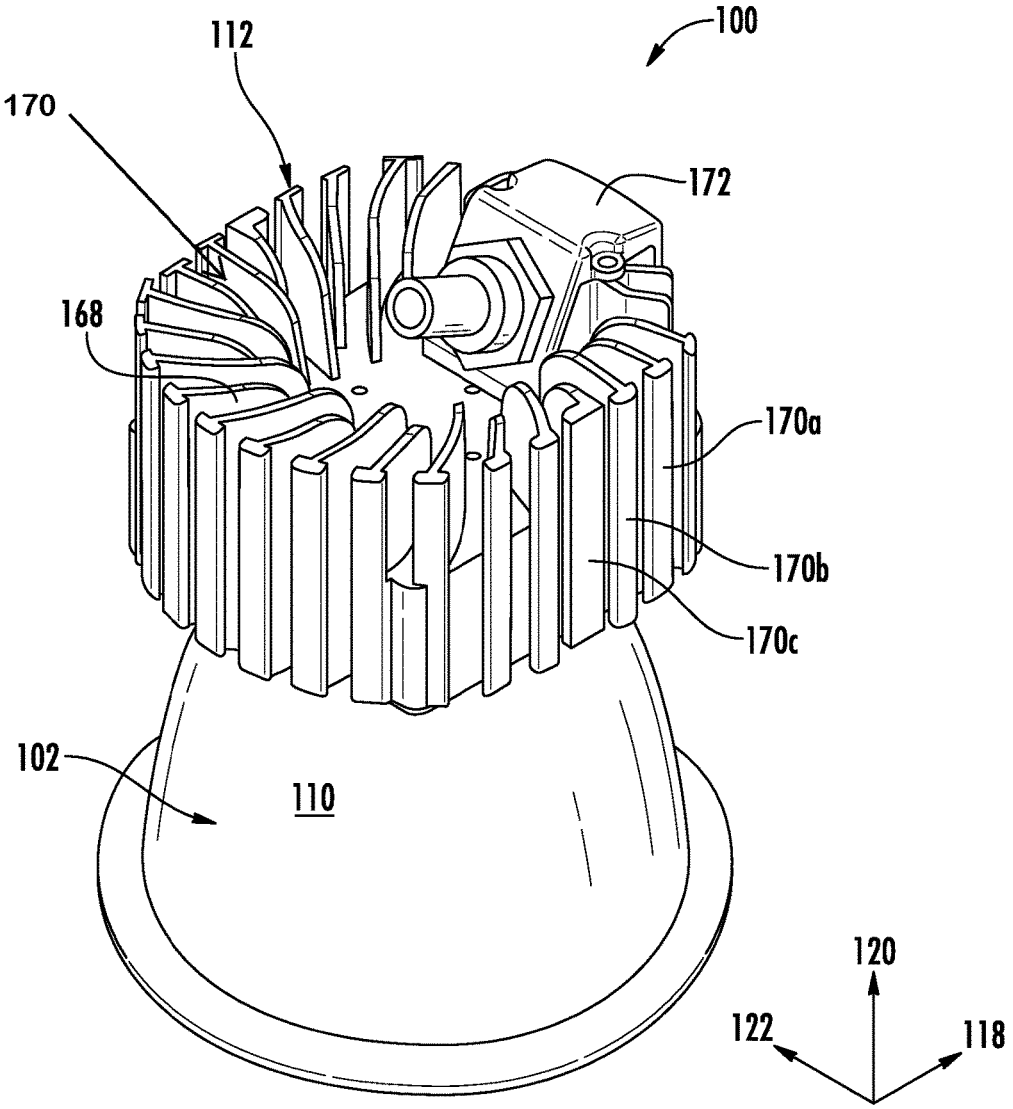
FIG. 3 depicts an isometric view of an optical assembly of the luminaire of FIG. 1, according to one or more aspects described herein.
Figure 5:
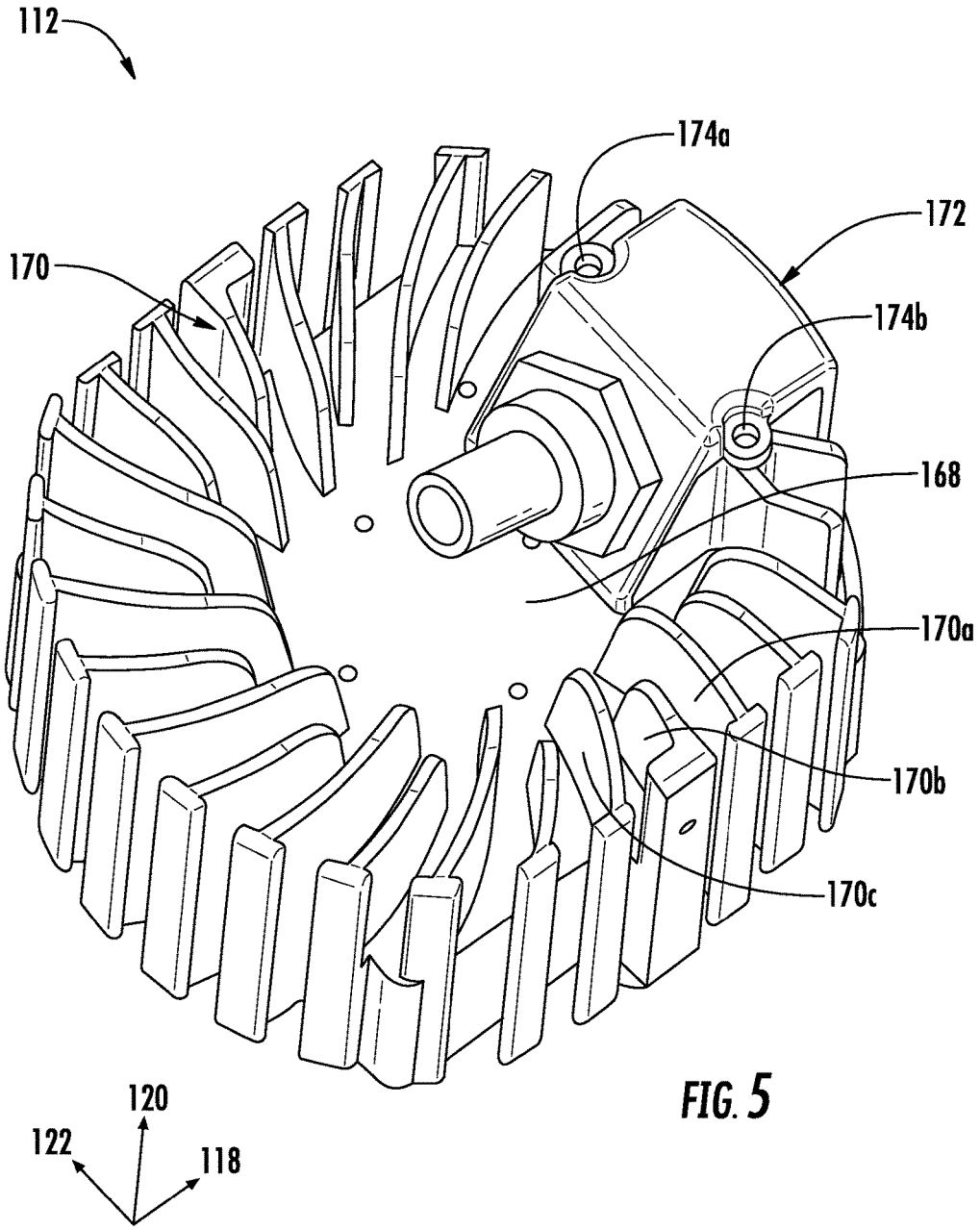
FIG. 5 depicts an isometric view of the top of the light engine assembly of FIG. 3, according to one or more aspects described herein.

FIGS. 3 and 5 depict isometric views of a top of the light engine assembly 112. The light engine assembly 112 may comprise a block structure 168. The block structure 168 may include a heat sink 170 and be integrally-formed with a plurality of fins. Accordingly, example fins 170*a*-170*c* represent three of a plurality of fins extending from the block structure 168. In one implementation, fins 170*a*-170*c* may be utilized to provide an increased surface area from which heat energy may be dissipated. Those of ordinary skill in the art will recognize that a rate of heat energy transfer (by convection) is linearly proportional to a surface area of an object that is being cooled (i.e. the circuit board or module 124). Additionally, those of ordinary skill in the art will recognize various heat sink fin configurations and geometries that may be utilized with light engine assembly 112, without departing from the scope of these disclosures. In one implementation, light engine assembly 112 may utilize a plurality of fins extending from a perimeter of the block structure 168. Turning again to FIG. 3, the plurality of fins (e.g. example fins 170*a*-170*c*) may extend in a plane parallel to a plane defined by directions 118 and 122. In one example, the plurality of fins (e.g. fins 170*a*-170*c*) of light engine assembly 112 may have an approximately circular outer boundary (when viewed from a top view as in FIG. 3), concentric with, and extending to a diameter less than, the aperture 143. The plurality of fins 170*a*-170*c* of the light engine assembly 112 may include two opposing flat sides which allow clearance for the means of removably attaching the light engine assembly 112 to the mounting frame 102. In one implementation, a fin from the plurality of fins that make up the light engine assembly 112, may have a curved geometry in order to increase surface area (see, e.g., curved geometry of fin 170*a* from FIG. 3).

The light engine assembly 112, including the block structure 168 integrally-formed with a plurality of fins (170*a*-170*c*) may comprise aluminum/an aluminum alloy (e.g. aluminum alloy 6061, 6063, or 1050A, among others), plastic, or copper/a copper alloy, among others. In one example, the light engine assembly 112, including the block structure 168 integrally-formed with a plurality of fins (170*a*-170*c*) may be cast, or molded (e.g. injection molding of a metal), among others. Additional or alternative machining/forming operations may be utilized to form the structure of the light engine assembly 112, without departing from the scope of these disclosures.

A cover structure 172 may be removably-coupled to the light engine assembly 112 at holes 174*a* and 174*b* by fasteners (e.g. screws, bolts, rivets, among others). Accordingly, the cover structure 172 may be removed to access a slot 184 in the block structure 168 of the light engine assembly 112 (described in further detail in relation to FIG. 8).

Figure 6:
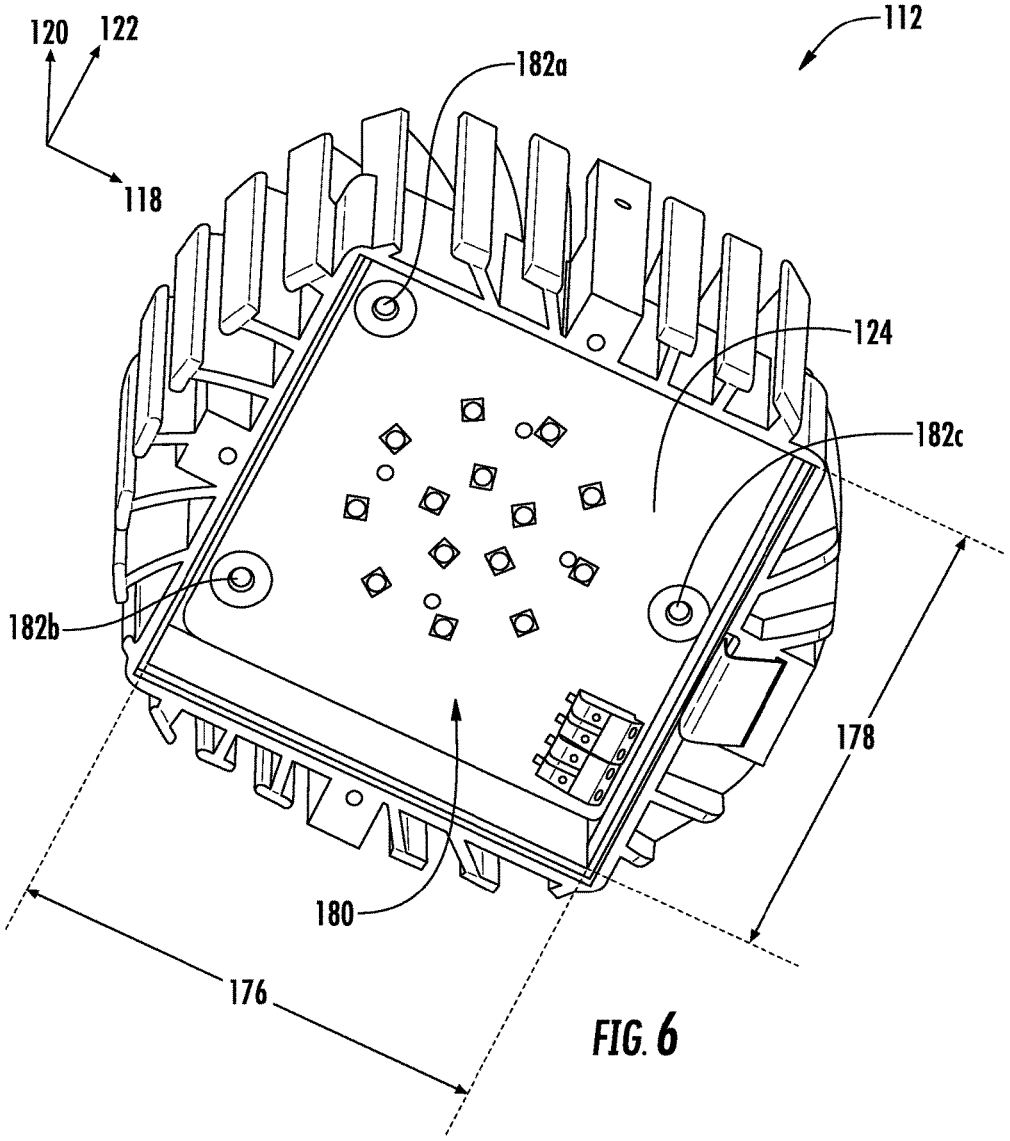
FIG. 6 depicts another isometric view of a bottom of the light engine assembly of FIG. 3, according to one or more aspects described herein.

FIG. 6 depicts an isometric view of a bottom of the light engine assembly 112. In particular, light engine assembly 112 is depicted without the cover plate 161 and reflective chamber 150 of FIG. 4A. In one example, the light engine assembly 112 has an aperture with a width 176 and a length 178. In one example, the aperture of the light engine assembly 112 has an approximately square geometry, and such that width 176 is approximately equal to length 178. The light engine assembly 112 may have a cavity 180 extending from the aperture (aperture associated with width 176 and length 178) along direction 120. In one example, the mounting points 182*a*-182*c* may be utilized to removably-couple the circuit board or LED module 124 to the light engine assembly 112. In one example, a surface area of the circuit board or LED module 124 may be approximately equal to an area of the aperture of the light engine assembly 112 (i.e. that area given by width 176*length 178). In another example, the light engine assembly 112 may be configured to accommodate circuit boards or LED modules (comprising one or more light sources) with a surface area smaller than the area of the aperture of the light engine assembly 112 (i.e. that area given by width 176*length 178), or greater than the area of the aperture of the light engine assembly 112 (i.e. that area given by width 176*length 178). In this way, light engine assembly 112 may be utilized with different light source circuits accommodated on different circuit board or LED module sizes, as offered by one or more different manufacturers. As such, one or more of the mounting points 182*a*-182*c* (as well as additional mounting points on the light engine assembly 112, but not utilized by the circuit board or LED module 124) may be associated with one or more mounting point patterns that are common to, or compatible with the circuit board or LED module 124, as well as alternative circuit boards or LED modules that may be positioned within the light engine assembly 112.

Figure 7:
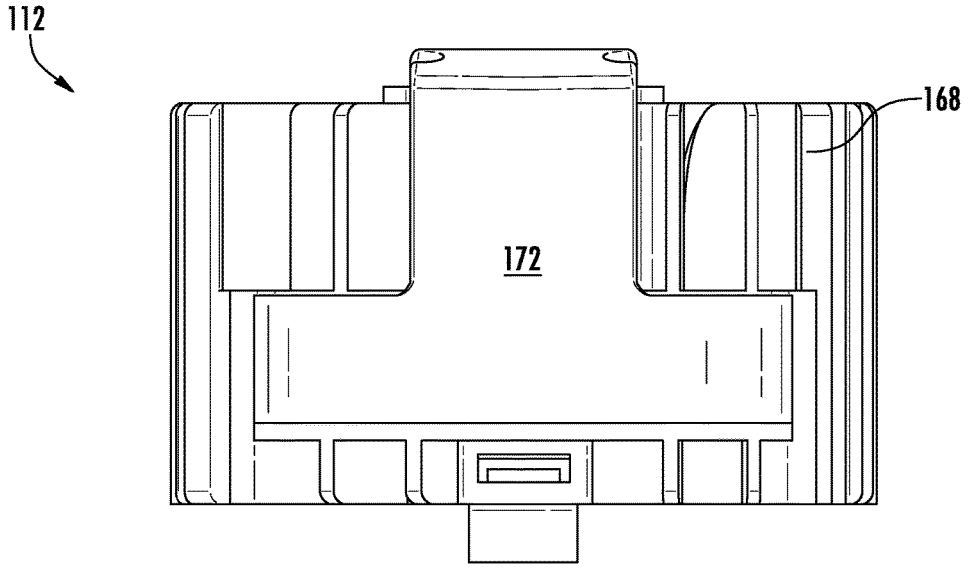
FIG. 7 depicts an end view of the light engine assembly of FIG. 3, according to one or more aspects described herein.
Figure 8:
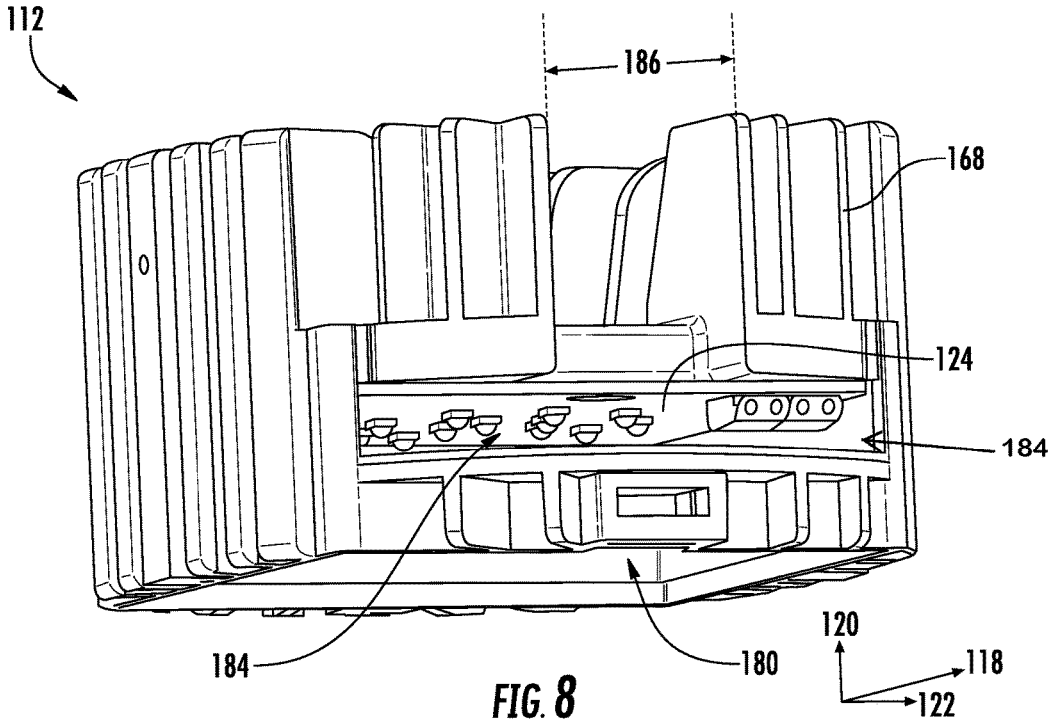
FIG. 8 depicts another end view of the light engine assembly of FIG. 3 according to one or more aspects described herein.

FIG. 7 depicts an end view of the light engine assembly 112. In particular, FIG. 7 depicts the cover structure 172 coupled to the light engine assembly 112. In contrast, FIG. 8 depicts the light engine assembly 112 with the cover structure 172 removed, and such that a slot 184 in a side of the light engine assembly 112 is exposed. The slot 184 may extend approximately along direction 118 through a sidewall of the block structure 168 into the cavity 180. The light engine assembly 112 may have a gap 186 in the fins of the heat sink 170 in order to accommodate electrical cabling extending from the circuit board or LED module 124 to the junction box 114. In one example, the cover structure 172 may be positioned within the gap 186.

Figure 9:
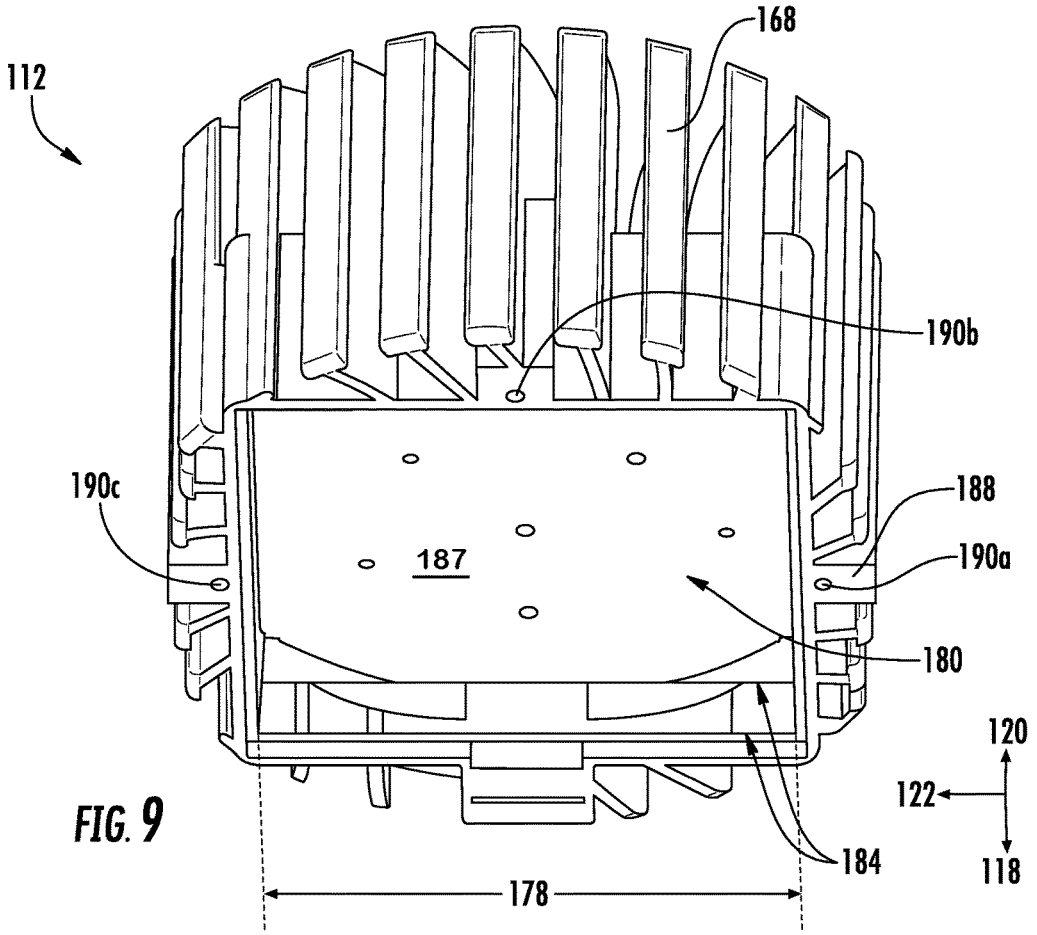
FIG. 9 depicts another view of a bottom of the light engine assembly of FIG. 3, according to one or more aspects described herein.

FIG. 9 depicts a view of the bottom of the light engine assembly 112. In one example, light engine assembly 112 may be referred to as a slot-loading light engine assembly 112 since a circuit board or LED module, such as circuit board or LED module 124, may be positioned within the cavity 180 by being loaded through the slot 184. FIG. 9 depicts the light engine assembly 112 without the circuit board or LED module 124. In one implementation, a width of the slot 184 may be approximately equal to length 178 associated with the aperture of the cavity 180. In another example, a width of the slot 184 may be less than, or more than length 178. In one example, element 187 represents a mounting surface onto which the circuit board or LED module 124, or an alternative implementation of a circuit board or LED module compatible with the light engine assembly 112, may be mounted. The mounting surface 187 may have a surface area that is larger than the area of the aperture of the light engine assembly 112 (i.e. that area given by width 176*length 178).

Surface 188 of the light engine assembly 112 may be referred to as a bottom surface of the light engine assembly 112, and may be removably-coupled to the cover plate 161 by fasteners 154*a*-154*c* that are received into holes 190*a*-190*c* (e.g. threaded holes 190*a*-190*c*).

Figure 10:
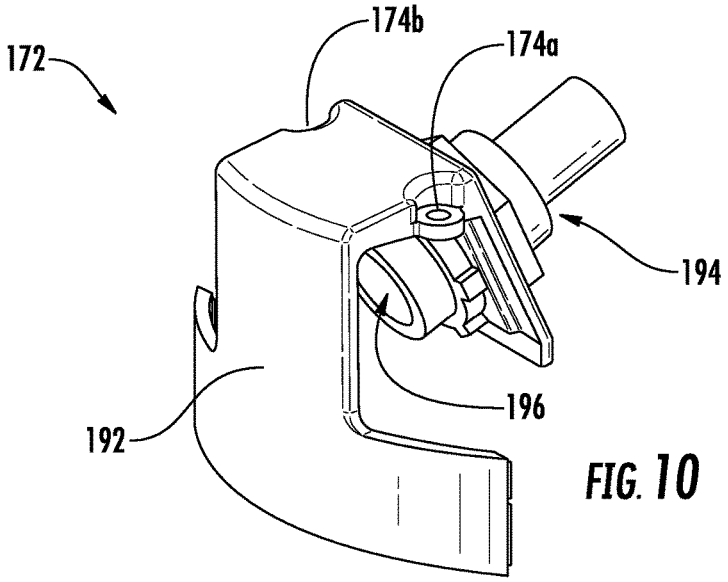
FIG. 10 depicts an isometric view of a cover structure, according to one or more aspects described herein.

FIG. 10 depicts an isometric view of the cover structure 172. The cover structure 172 may have a plate 192 configured to be received into the gap 186 in the fins of the block structure 168 of the light engine assembly 112 as well as the slot 184. Additionally, the cover structure 172 may comprise a wire port 194 having a cylindrical bore 196 through which one or more electrical wires may extend between the circuit board or LED module 124 and the junction box 114. The cover structure 172 may comprise one or more aluminum alloys or copper alloys, among others. In another example, the cover structure 172 may comprise one or more polymer materials, among others. The cover structure 172 may be sized and shaped to accommodate other circuit board or LED module 124 geometries where the circuit board or LED module 124 and wires associated with the circuit board or LED module 124 are connected along various portions of the circuit board or LED module 124, for example not centered on the edge of the circuit board or LED module 124.

Figure 11:
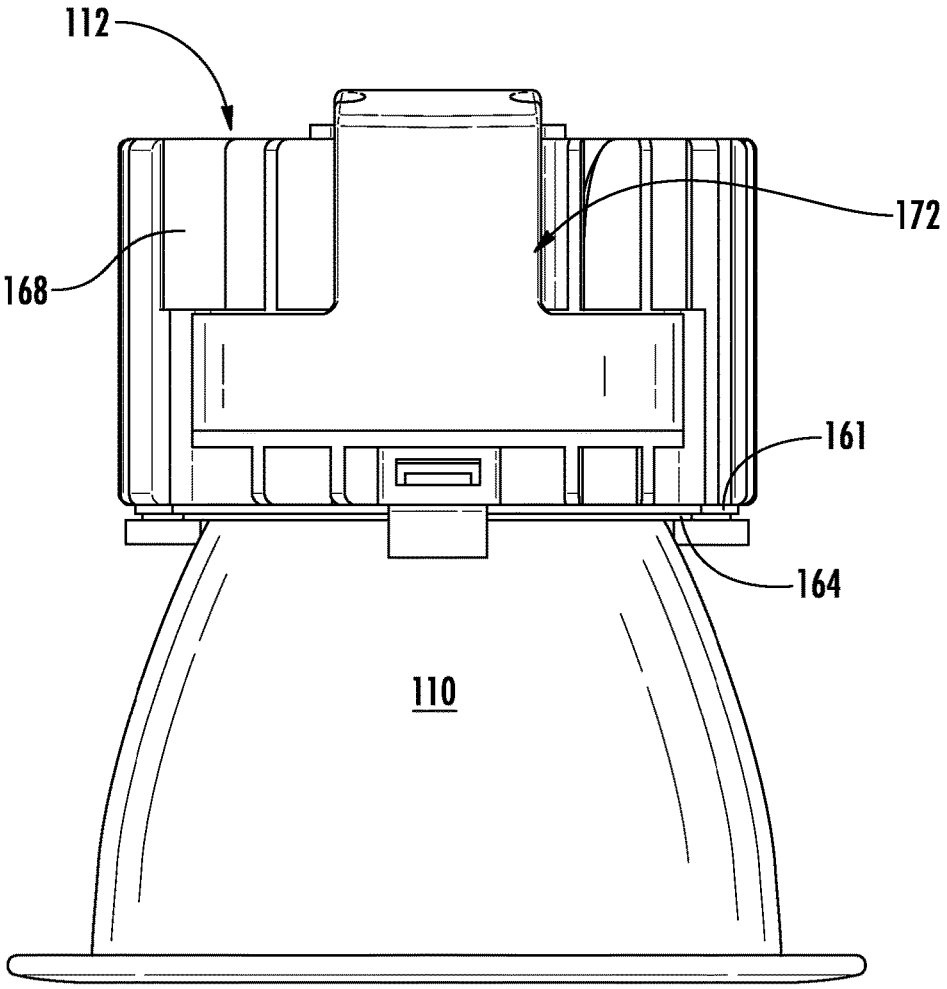
FIG. 11 depicts an elevation view of the optical assembly of FIG. 1, according to one or more aspects described herein.
Figure 12A:
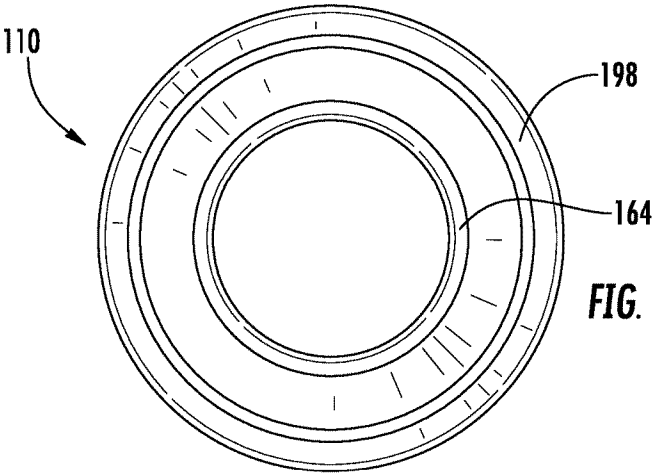
FIGS. 12A-12C depict different views of an example round or circular reflector assembly from the optical assembly of FIG. 11, according to one or more aspects described herein.
Figure 12B:
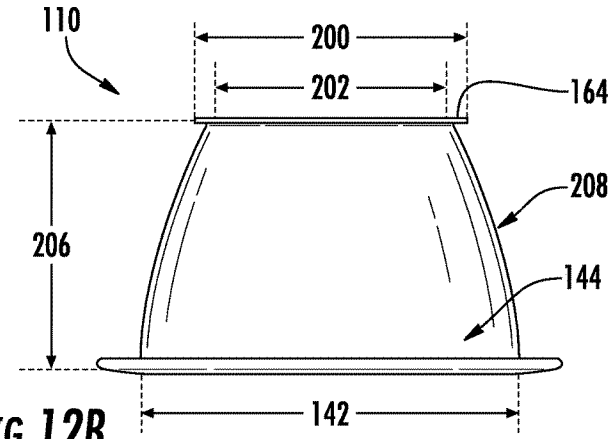
Figure 12C:
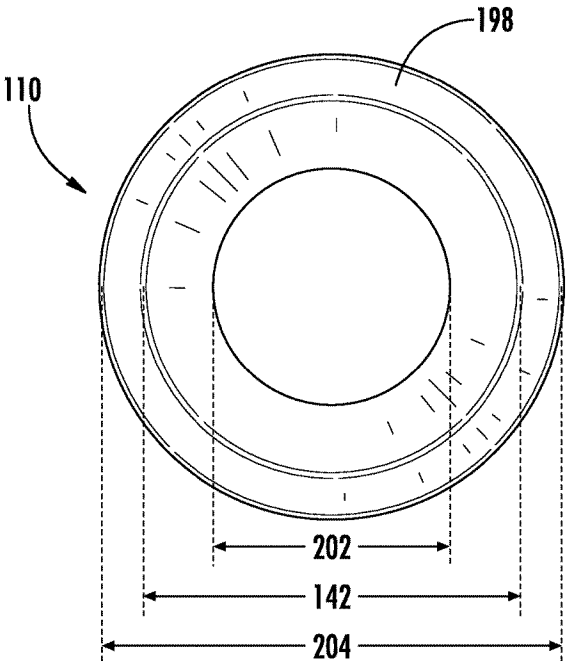

FIGS. 11-12C illustrate an optical assembly that includes a circular reflector assembly. Specifically, FIG. 11 depicts an elevation view of an optical assembly of the luminaire 100. As previously discussed, the light engine assembly 112 may be slidably engaged with an upper flange 164 of the reflector assembly 110, such that the upper flange 164 is removably-coupled to the light engine assembly 112 against the cover plate 161 and by fasteners 154*a*-154*c* and the leaf spring 156 or the manual slide closure 156*b*. However, reflector assembly 110 may be one example reflector, of a plurality of reflectors that may be compatible with light engine assembly 112. The reflector assembly 110 is depicted in further detail in FIGS. 12A-12C. In particular, FIG. 12A depicts a top view of the reflector assembly 110, FIG. 12B depicts a front view of the reflector assembly 110, and FIG. 12C depicts a bottom view of the reflector assembly 110. The reflector assembly 110 may have an upper flange 164 with an outer diameter 200 greater than a diameter 202 of an upper aperture of the reflector assembly 110. In one example, the upper aperture diameter 202 may be approximately equal to a diameter of aperture 166. The reflector assembly 110 may also have a lower flange 198 extending from a lower portion 144 of the reflector assembly 110. This lower flange 198 may have an outer diameter 204. The reflector assembly 110 may have a height 206. Accordingly, the reflector assembly 110 may be embodied with any value for distances 200, 202, 204, and 206, among others. Similarly, the depicted examples of luminaire 100 may be implemented with any dimensional values, without departing from the scope of these disclosures. In one example, reflector assembly 110 has a geometry, associated with sidewall 208, comprising at least a portion of a paraboloid of revolution. In another example, reflector assembly 110 may have a sidewall 208 with a curved or angled surface described by additional or alternative geometries.

Figure 13:
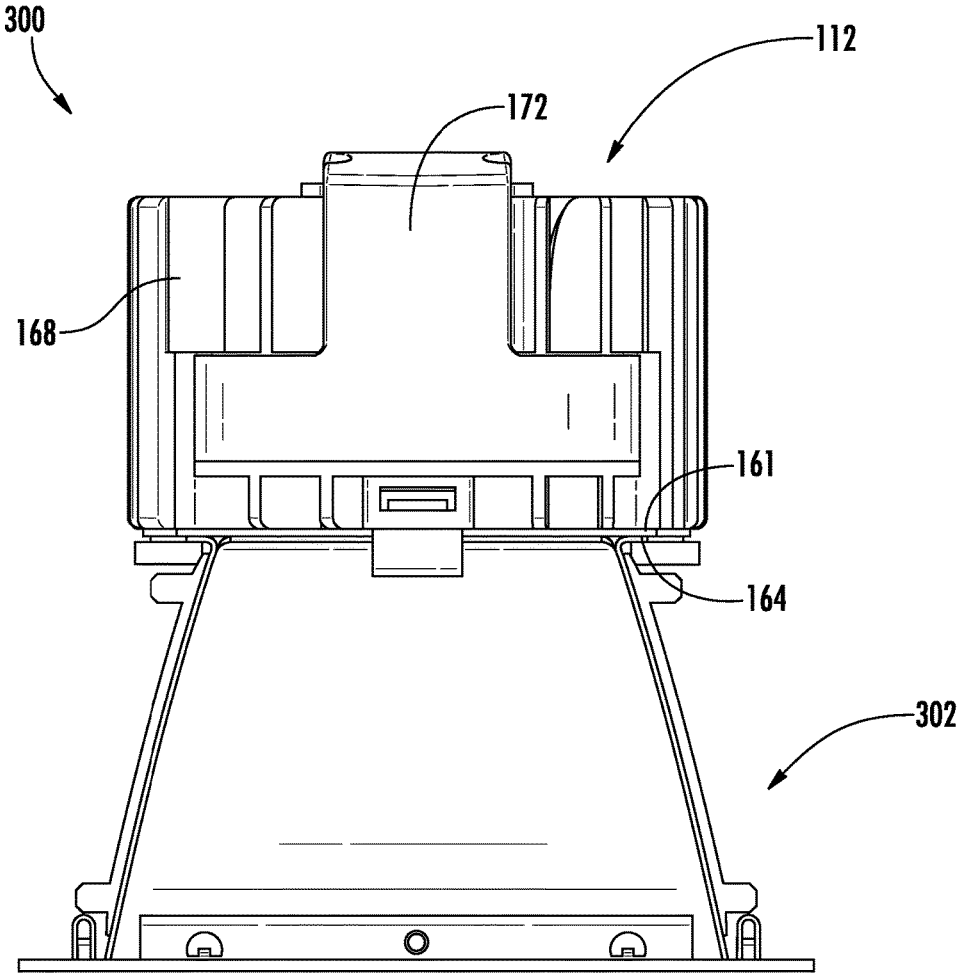
FIG. 13 depicts an elevation view of another example optical assembly, according to one or more aspects described herein.
Figure 14A:
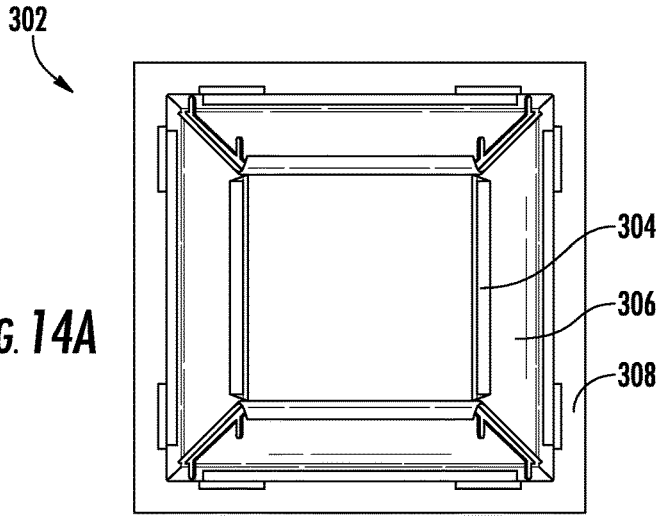
FIGS. 14A-14C depict different views of a square or rectangular reflector assembly from the optical assembly of FIG. 13, according to one or more aspects described herein.
Figure 14B:
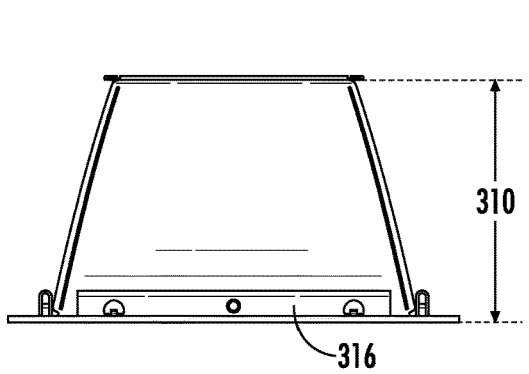
Figure 14C:
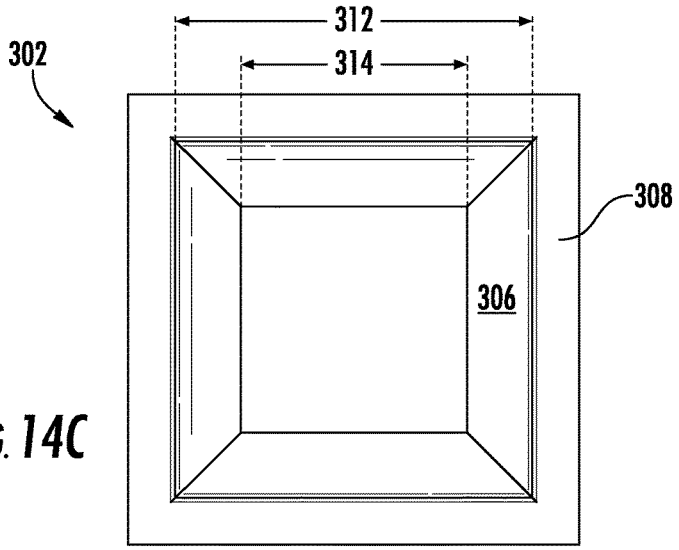
Figure 15:
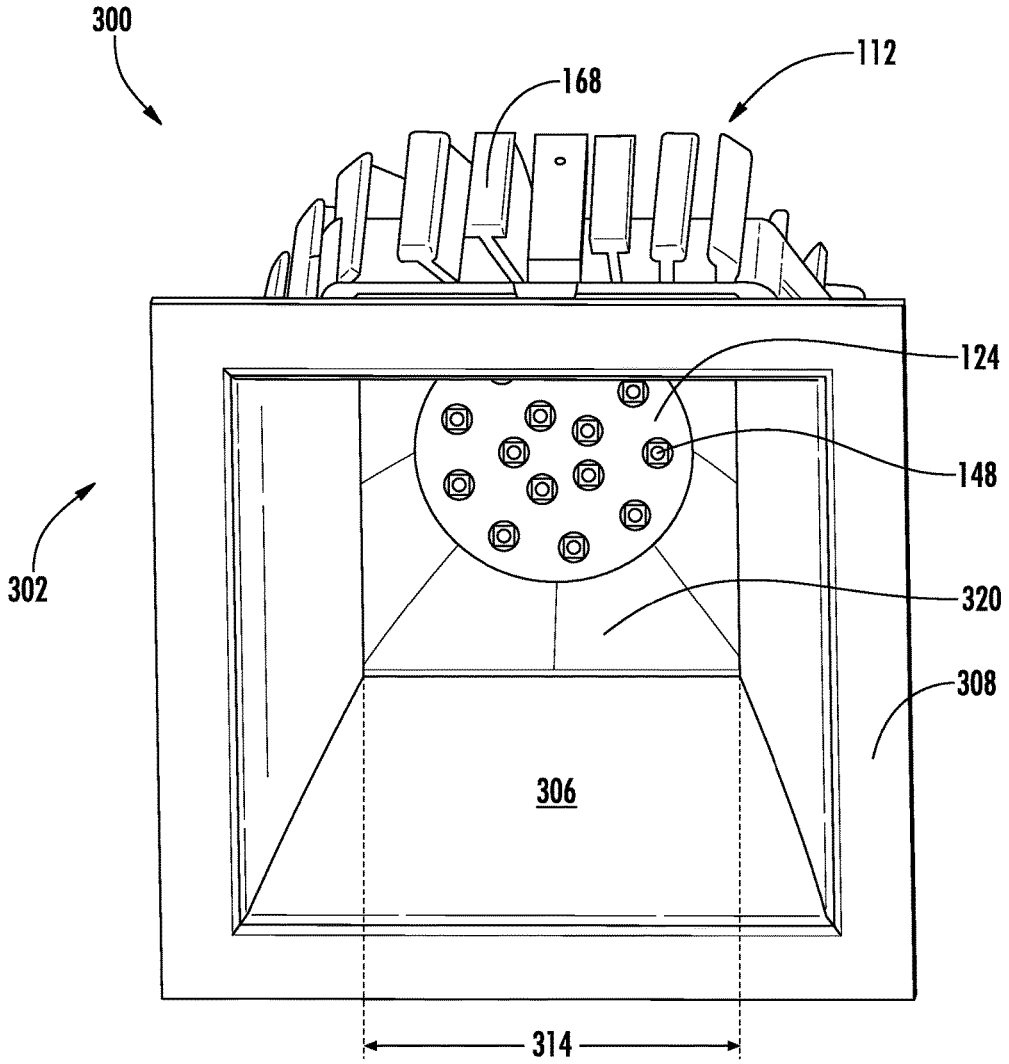
FIG. 15 depicts a bottom view of the example optical assembly of FIG. 13, according to one or more aspects described herein.

FIGS. 13-15 illustrate an optical assembly that includes a square (or rectangular) reflector assembly. Specifically, FIG. 13 depicts an elevation view of an optical assembly 300 and FIG. 15 illustrates a bottom view of the optical assembly 300. In particular, optical assembly 300 may comprise light engine assembly 112 (as well as a circuit board or LED module, similar to circuit board or LED module 124). Optical assembly 300, however, may be implemented with a reflector assembly 302 having a different geometry to reflector assembly 110. As such, further details of reflector assembly 302 are described with reference to FIGS. 14A-14C. In particular, FIG. 14A depicts a top view of the reflector assembly 302, FIG. 14B depicts a front view of the reflector assembly 302, and FIG. 14C depicts a bottom view of the reflector assembly 302. The reflector assembly 302 may have an upper flange 304, similar to the upper flange 164 of reflector assembly 110. In the upper flange 304 may have a substantially rectangular, or square shape, and be configured to slidably engage with the light engine assembly 112. E.g. the upper flange 304 may slidably engage with the light engine assembly 112 such that it is removably-coupled to the light engine assembly 112 against the cover plate 161 and by fasteners 154*a*-154*c* and the leaf spring 156 or the manual slide closure 156*b*. The reflector assembly 302 may have a sidewall 306 extending distance 310 between the upper flange 304 and a lower flange 308. In one example, the reflector assembly 302 may have a geometry comprising a square frustum (a square-based pyramid) having a lower portion with side length 312 (otherwise referred to as a lower aperture 312), and an upper portion with side length 314 (otherwise referred to as an upper aperture 314). The reflector assembly 302 may comprise one or more mounting surfaces 316 configured to interface with an aperture plate, similar to aperture plate 106, but having a rectangular, or square aperture.

FIG. 15 depicts a bottom view of the optical assembly 300. Accordingly, as depicted, the reflector assembly 302 may be removably-coupled to the light engine assembly 112, and such that one or more light sources 148 of the circuit board or LED module 124 may emit light through aperture 312. The optical assembly 300 may have a reflective chamber 320, similar to reflective chamber 150, but having a square lower aperture corresponding to the upper aperture 314 of the reflector assembly 302, and a circular upper aperture 318. Aperture 318 may be square also or various other geometries.

Figure 16:
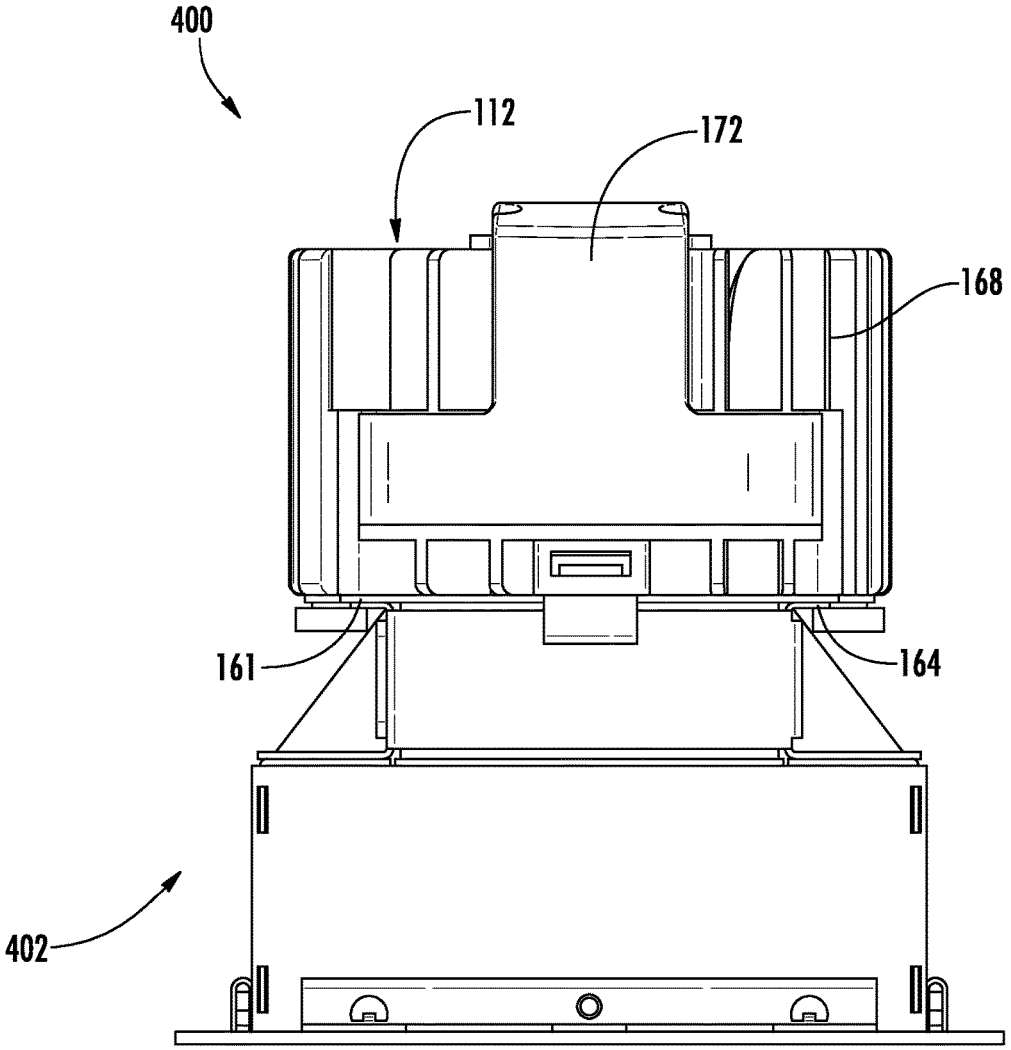
FIG. 16 depicts an elevation view of another example optical assembly, according to one or more aspects described herein.
Figure 17A:
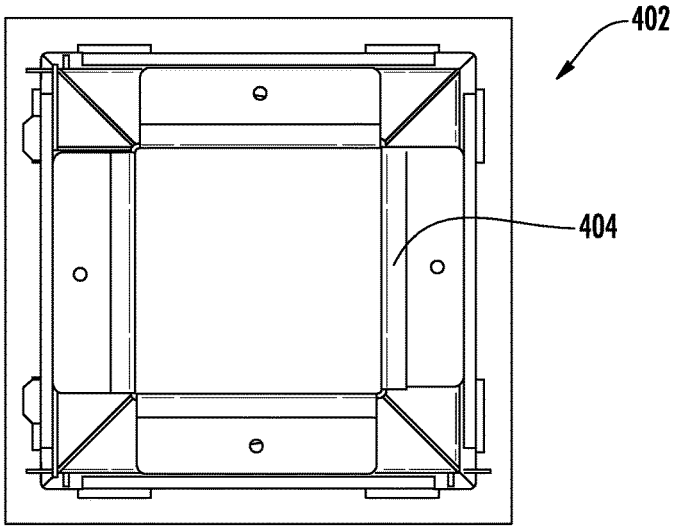
FIGS. 17A-17C depict different views of a square or rectangular wall-wash reflector assembly from the optical assembly of FIG. 13, according to one or more aspects described herein.
Figure 17B:
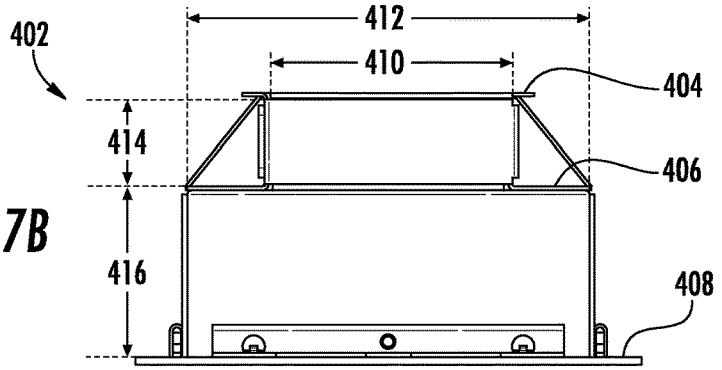
Figure 17C:
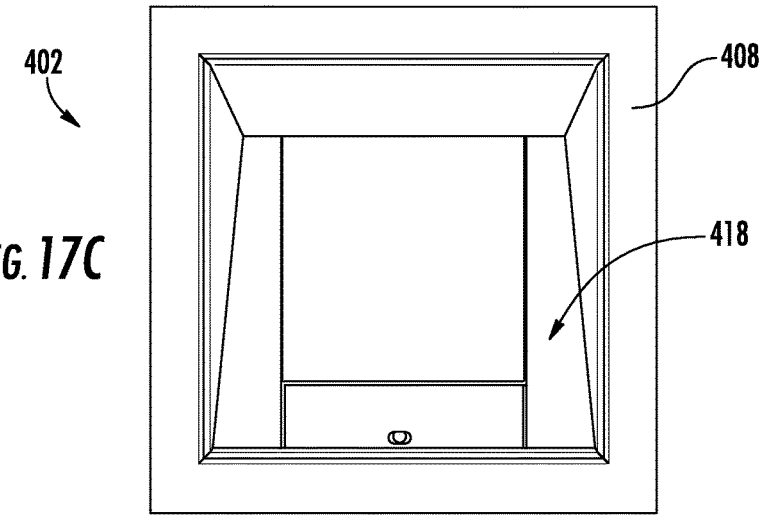
Figure 18:
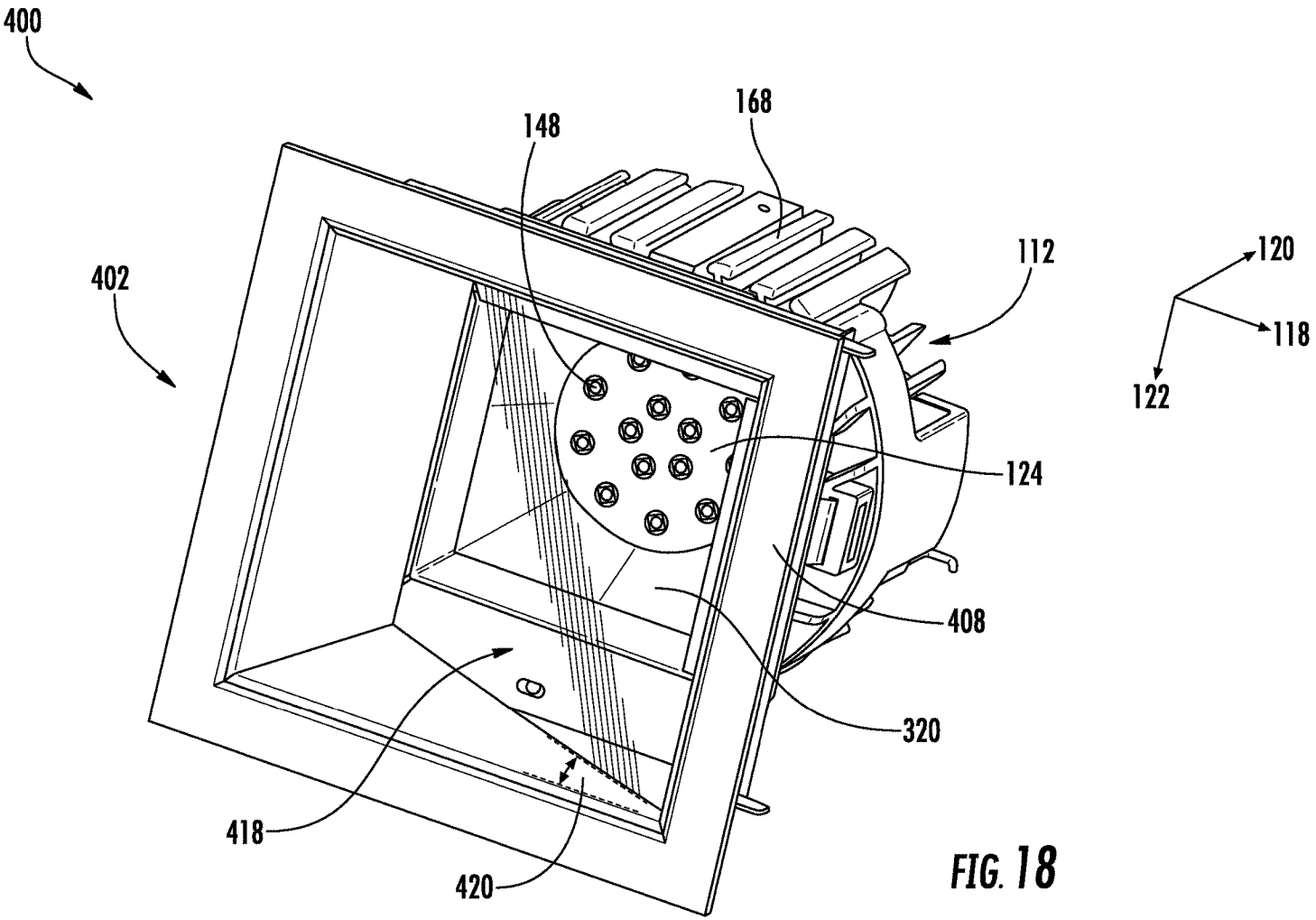
FIG. 18 depicts a bottom view of the example optical assembly of FIG. 16, according to one or more aspects described herein.

FIGS. 16-18 illustrate an optical assembly that includes a square (or rectangular) wall-wash-type reflector assembly. Specifically, FIG. 16 depicts an elevation view of an optical assembly 400 acting as a wall wash luminaire. Optical assembly 400 may comprise light engine assembly 112, as well as a circuit board or LED module (not pictured in FIG. 16), similar to circuit board or module 124, comprising one or more light sources 148. Optical assembly 400 may be implemented with a reflector assembly 402 configured to slidably engage with the light engine assembly 112, similar to reflector assemblies 110 and 302. Further details of reflector assembly 402 are detailed in FIGS. 17A-17C. In particular, FIG. 17A depicts a top view of the reflector assembly 402, FIG. 17B depicts a front view of reflector assembly 402, and FIG. 17C depicts a bottom view of the reflector assembly 402. The reflector assembly 402 may have a top flange 404 that has a substantially rectangular, or square shape, and configured to slidably engage with the light engine assembly 112 in a similar manner to reflector assembly 110 and reflector assembly 302. Additionally, a lower flange 408 may extend from the lower aperture 412. In one implementation, the reflector assembly 402 may comprise a sloped internal lens structure 418, as depicted in FIG. 18.

FIG. 18 depicts a bottom view of optical assembly 400. In particular, the reflector assembly 402 may be square and comprise a sloped internal lens structure 418 extending in a plane that is non-parallel to a horizontal plane defined by those directions 118 and 122, and non-parallel to a vertical plane defined by those directions 118 and 120. The sloped internal lens structure 418 may provide wall-wash properties, thereby directing the light emitted from the light sources 148 in a specific direction. In one example, a plane of the slope internal lens structure 418 is angled. In one implementation, the internal lens structure 418 may comprise a transparent or partially transparent material configured to focus, diffuse, change color temperature or hue of light emitted by one or more light sources 148.

Figure 19:
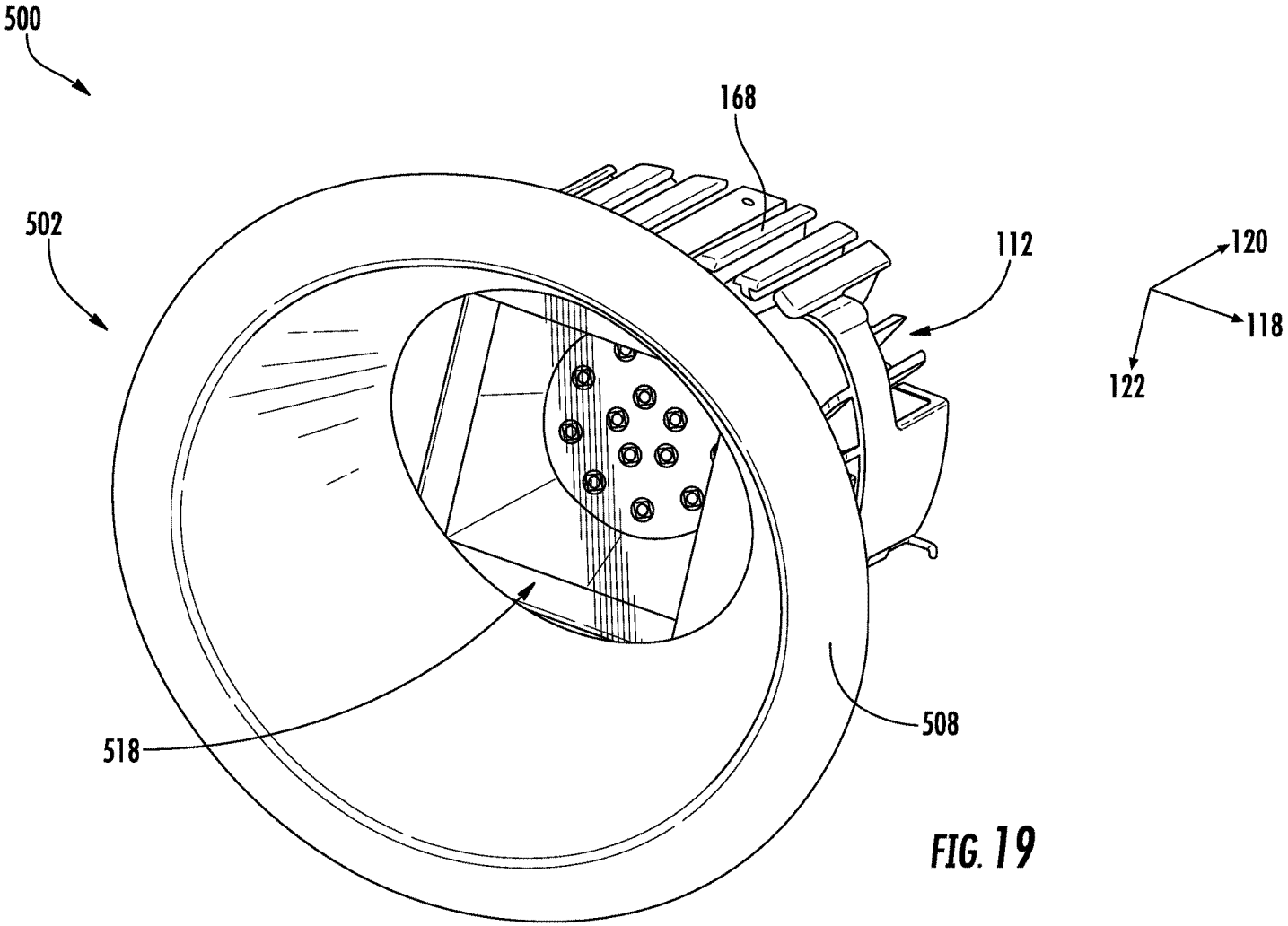
FIG. 19 depicts a bottom view of another example optical assembly with a circular wall-wash reflector assembly, according to one or more aspects described herein.

FIG. 19 illustrates an optical assembly that includes a circular wall-wash-type reflector assembly. As shown, FIG. 19 depicts a bottom view of optical assembly 500. In particular, the reflector assembly 502 may be circular and comprise a sloped internal lens structure 518 extending in a plane that is non-parallel to a horizontal plane defined by those directions 118 and 122, and non-parallel to a vertical plane defined by those directions 118 and 120. The sloped internal lens structure 518 may provide wall-wash properties, thereby directing the light emitted from the light sources 148 in a specific direction. In one example, a plane of the slope internal lens structure 518 is angled. In one implementation, the internal lens structure 518 may comprise a transparent or partially transparent material configured to focus, diffuse, change color temperature or hue of light emitted by one or more light sources 148.

The optical assemblies may be interchangeable for use in a luminaire to go from a downlight to a wall wash. Additionally, the optical assemblies 300 and 400 may be interchangeable to go from a downlight to a wall wash. The optical assembly 400 or 500 may be rotated in 90 degree increments to aim at the wall for different lighting requirements.

In the foregoing, reference is made to the various elements as having one or more of a "top," "bottom," "front," "back," "left," and/or "right" side, and/or a "horizontal," or "vertical" orientation. However, these terms are merely associated with one example orientation used to aid in the description of the various elements of this disclosure. As such, the disclosed implementations in the foregoing are not limited to any one orientation. Similarly, the various elements described throughout this disclosure may be scaled in proportion to one another, such that the various implementations described herein may have any dimensional values. In another example, one or more elements described in this disclosure may be scaled disproportionately, and such that the accompanying Figures may not represent true proportions of the various elements described herein.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A luminaire, comprising:
- a light engine assembly comprising:
  - a plurality of fins, integrally-formed with, and extending from, a block structure;
  - a cavity extending in a first direction from the block structure creating an aperture;
  - a slot, extending through a sidewall of the block structure into the cavity in a second direction, perpendicular to the first direction, the slot comprising a mounting surface having a total surface area equal to or larger than a total area of the aperture;
- a reflector assembly slidably engaged with the light engine assembly;
- an LED module, removably-coupled to the mounting surface, comprising at least one light source configured to emit light through the aperture, wherein the LED module is removable from the cavity and slidable through the slot; and
- a cover plate removably-coupled between a lower surface of the light engine assembly and an upper flange of the reflector assembly.

2. The luminaire of claim 1, wherein the cover plate is removably-coupled to the light engine assembly with one or more fasteners that provide a standoff distance between a surface of the cover plate and a flange of the one or more fasteners.

3. The luminaire of claim 2, wherein the standoff distance allows the reflector assembly to slidably engage with the light engine assembly and wherein the upper flange of the reflector assembly slidably engages with the light engine assembly such that the upper flange of the reflector assembly is sandwiched between the flange of the one or more fasteners and the cover plate.

4. The luminaire of claim 1, further comprising a reflective chamber positioned within the aperture of the light engine assembly.

5. The luminaire of claim 4, further comprising a diffuser plate positioned adjacent to the reflective chamber, wherein the diffuser plate is configured to focus, scatter, diffuse, or alter the light emitted from the light source.

6. The luminaire of claim 5, further comprising a lens cover positioned adjacent to the diffuser plate and the reflective chamber.

7. The luminaire of claim 6, further comprising a cover plate that secures the lens cover, the diffuser plate, and the reflective chamber to the light engine assembly.

8. A luminaire comprising:

a light engine assembly comprising:

a block structure including a heat sink;

a plurality of fins integrally-formed with, and extending from the block structure;

a cavity extending in a first direction from an aperture in a bottom surface of the block structure;

a slot extending through a sidewall of the block structure into the cavity in a second direction, perpendicular to the first direction, the slot comprising a mounting surface having a total surface area larger than a total area of the aperture; and an LED module, removably-coupled to the mounting surface, comprising at least one light source configured to emit light through the aperture;

a reflector assembly slidably engaged with the block structure; and a cover plate removably-coupled between a lower surface of the block structure and an upper flange of the reflector assembly, wherein the cover plate is removably-coupled to the light engine assembly with one or more fasteners that provide a standoff distance between a surface of the cover plate and a flange of the one or more fasteners and the standoff distance allows the reflector assembly to slidably engage with the block structure, and further wherein the upper flange of the reflector assembly slidably engages with the light engine assembly such that the flange of the reflector assembly is sandwiched between the flange of the one or more fasteners and the cover plate.

9. The luminaire of claim 8, wherein the LED module is removable from the cavity and slidable through the slot.

10. The luminaire of claim 9, wherein the at least one light source is a light-emitting diode.

11. The luminaire of claim 8, wherein a width of the slot is approximately equal to a width of the aperture.

12. The luminaire of claim 8, further comprising a reflective chamber positioned within the aperture of the light engine assembly.

13. The luminaire of claim 12, further comprising a diffuser plate positioned adjacent to the reflective chamber, wherein the diffuser plate is configured to focus, scatter, diffuse, or alter the light emitted from the light source.

14. The luminaire of claim 13, further comprising a lens cover positioned adjacent to the diffuser plate and the reflective chamber.

15. The luminaire of claim 14, wherein the cover plate that secures the lens cover, the diffuser plate, and the reflective chamber to the light engine assembly.

* * * * *